US006318272B1

(12) United States Patent
Mey

(10) Patent No.: US 6,318,272 B1
(45) Date of Patent: Nov. 20, 2001

(54) BREAKING OR BLASTING OR SPLITTING OF ROCK

(75) Inventor: Johann Mey, Parow (ZA)

(73) Assignee: Denel (Proprietary) Limited, Pretoria (ZA)

( * ) Notice: Subject to any disclaimer, the term of this patent is extended or adjusted under 35 U.S.C. 154(b) by 0 days.

(21) Appl. No.: 09/077,445

(22) PCT Filed: Dec. 6, 1996

(86) PCT No.: PCT/US96/19496

§ 371 Date: Jan. 8, 1999

§ 102(e) Date: Jan. 8, 1999

(87) PCT Pub. No.: WO97/21068

PCT Pub. Date: Jun. 12, 1997

(30) Foreign Application Priority Data

Dec. 6, 1995 (ZA) ..... 95/10370

(51) Int. Cl.[7] ..... F42D 3/00

(52) U.S. Cl. ..... 102/302; 102/312; 102/313; 102/315; 166/299

(58) Field of Search ..... 102/302, 315, 102/312, 313; 166/299

(56) References Cited

U.S. PATENT DOCUMENTS

| | | | | |
|---|---|---|---|---|
| 1,379,637 | * | 5/1921 | McKinlay | 102/315 |
| 2,929,325 | * | 3/1960 | Lewis | 102/315 |
| 3,580,171 | * | 5/1971 | Maes | 102/315 |
| 3,616,855 | * | 11/1971 | Colgate | 166/299 |
| 3,618,520 | | 11/1971 | Hamasaki et al. | 102/23 |
| 3,815,501 | * | 6/1974 | Anderson et al. | 102/315 |
| 4,006,687 | * | 2/1977 | Ridgeway | 102/315 X |
| 4,592,282 | * | 6/1986 | Niemi et al. | 299/13 X |
| 5,098,163 | | 3/1992 | Young | 299/13 |
| 5,233,926 | * | 8/1993 | Carmichael et al. | 102/313 X |
| 5,419,257 | * | 5/1995 | Liechter et al. | 102/315 |
| 5,773,750 | * | 6/1998 | Jae et al. | 102/315 X |
| 5,874,688 | * | 2/1999 | Lubbe et al. | 102/313 X |

FOREIGN PATENT DOCUMENTS 800883 9/1958 (GB) .

* cited by examiner

*Primary Examiner*—Peter A. Nelson
(74) *Attorney, Agent, or Firm*—Ladas & Parry

(57) ABSTRACT

A method of breaking rock (18), e.g. in underground mining, includes drilling a hole in the rock mass by means of a drilling machine (20) having an articulated boom (22) and a drilling tool (24) at the end of the boom (22). After drilling, the drilling tool (20) is retracted, charge means is indexed with the hole, and a rock breaking charge (30) is charged into the hole. The charge (30) includes a propellant, a fuse head (40), and a tamping medium (34), conveniently contained in the casing (32). The tamping medium (34), e.g. a two-component resin, is discharged into the hole and allowed to set around and rearward of the propellant. The driving machine (20) is removed and the propellant is actuated from a remote position, e.g. electrically.

10 Claims, 6 Drawing Sheets

BREAKING OR BLASTING OR SPLITTING OF ROCK

THIS INVENTION relates to breaking or splitting of rock or the like. The invention relates more specifically to a method of breaking or splitting of rock or the like, and also to a rock breaking charge suitable for use in breaking or splitting of rock or the like.

The Applicant expects the invention to be of particular importance in mining, but it will also be applicable in other fields like civil construction, and the like.

In the specification, reference will be made to drilling of holes in rocks to be broken. Such holes can be drilled at virtually any orientation or attitude. However, for purposes of this specification, the term "bottom of the hole" or similar wording must be interpreted to indicate a blind end of the hole.

Further, in the specification, reference is made to a rock breaking charge. For purposes of this invention, "rock breaking charge" is to be limited to a charge which includes a non-detonating substance, for example (and preferably) a propellant.

Furthermore, in the specification, reference will be made to a tamping medium which, optionally, may be in the form of a "flowable substance". "Flowable substance" or similar wording must be interpreted to include a liquid and also a substance which can be urged to flow under pressure including a colloid, gel, or the like.

Further, in the specification, reference is made to a rock breaking charge. For purposes of this invention, "rock breaking charge" is to be limited to a charge which includes a non-detonating substance, for example (and preferably) a propellant.

In accordance with a first aspect of this invention, there is provided a method of breaking or splitting of rock or the like, the method including providing a drilling machine having drilling means to dill a hole in rock or the like along an operating axis, charging means for charging a charge into a hole, and indexing means for selectively withdrawing the drilling means from the operating axis and indexing the charging means with the operating axis;

- drilling a hole in rock by means of the drilling means along an operating axis;
- withdrawing the drilling means and indexing the charging means with the operating axis;
- charging a rock breaking charge by means of the charging means along the operating axis into the hole; and
- actuating the rock breaking charge from a remote position.

The method may include removing the drilling machine from the vicinity of the rock prior to actuating the rock breaking charge.

Charging the rock breaking charge may be by pushing it along the hole. Instead, charging the rock breaking charge may be by launching it at speed into the hole to cause the momentum of the charge to displace it down the hole.

The charge may be a composite charge comprising a plurality of components, the charge being contained in a casing. The charge may include a pressure generating substance toward a leading end of the casing and a tamping medium trailing the pressure generating substance, the tamping medium being in the form of settable, flowable substance.

Advantageously, the method may include displacing air from the bottom of the hole around the pressure generating substance. Said displacing air may be by displacing the tamping medium into spaces at the bottom of the hole around the pressure generating substance. Displacing the tamping medium may be by means of a plunger urged into the hole from behind the tamping medium.

In one method, the tamping medium may be in the form of a two component epoxy resin, the method then including forcing the components into contact in a mixing chamber provided for that purpose in the casing and thence into said spaces.

Instead, the method may include mixing the components by rotating the plunger while it is urged into the hole.

Preferably, actuating the charge may be electrically, the charge including conductors anchored in the charge and being extensible out of the hole to the remote location.

Instead, actuating the charge may be by means of a chemical time delay device.

In accordance with a second aspect of this invention, there is provided a rock breaking charge including

- a pressure generating substance;
- actuating means for actuating the pressure generating substance;
- a tamping medium;
- a casing containing the pressure generating substance and the actuation means toward one end thereof, and the tamping medium spaced from said one end.

The casing may be elongate and of generally round cross section, and suitable for insertion into a hole drilled in a rock to be broken, said one end being a leading end.

Advantageously, the pressure generating substance may be contained in a cartridge and the actuation means may be in the form of an electrically actuable fuse head, the tamping medium being in the form of a settable, flowable substance.

In some embodiments, the casing may be a composite casing, the cartridge providing a portion of the casing.

The rock breaking charge may include passage means for conducting the tamping medium prior to setting into spaces surrounding the cartridge when received in a hole in a rock in use.

The tamping medium may be in the form of a two component epoxy resin. Then, the rock breaking charge may include a mixing chamber in communication with the passage means and the two-component epoxy resin, the components of the epoxy being arranged to be urged into the mixing chamber to be mixed and thence into the passage means and into the spaces. Instead, the rock breaking charge may include rotatable agitation means for mixing the components of the epoxy resin.

The invention is now described by way of example with reference to the accompanying diagrammatic drawings. In the drawings FIG. 1 shows, schematically, in side view, an underground mining operation in which a method in accordance with this invention is performed;

Figure 4:
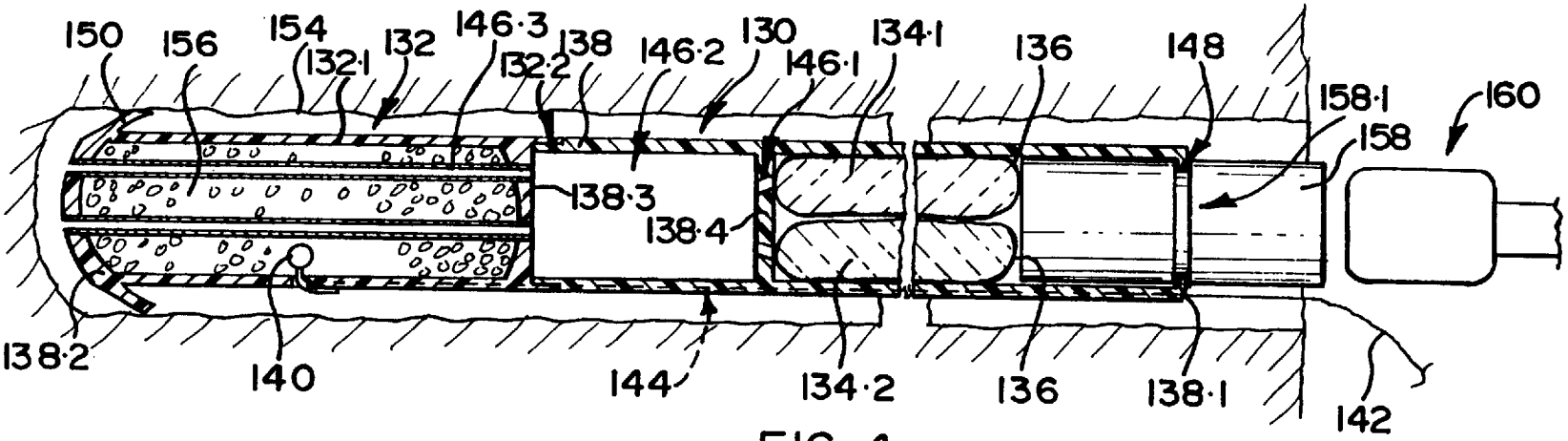
FIGS. 4 and 5 show, respectively in sectional side view, a further embodiment of a charge in accordance with this invention, respectively before a tamping medium thereof has been mixed and distributed, and while a tamping medium thereof is being mixed and distributed.
Figure 5:
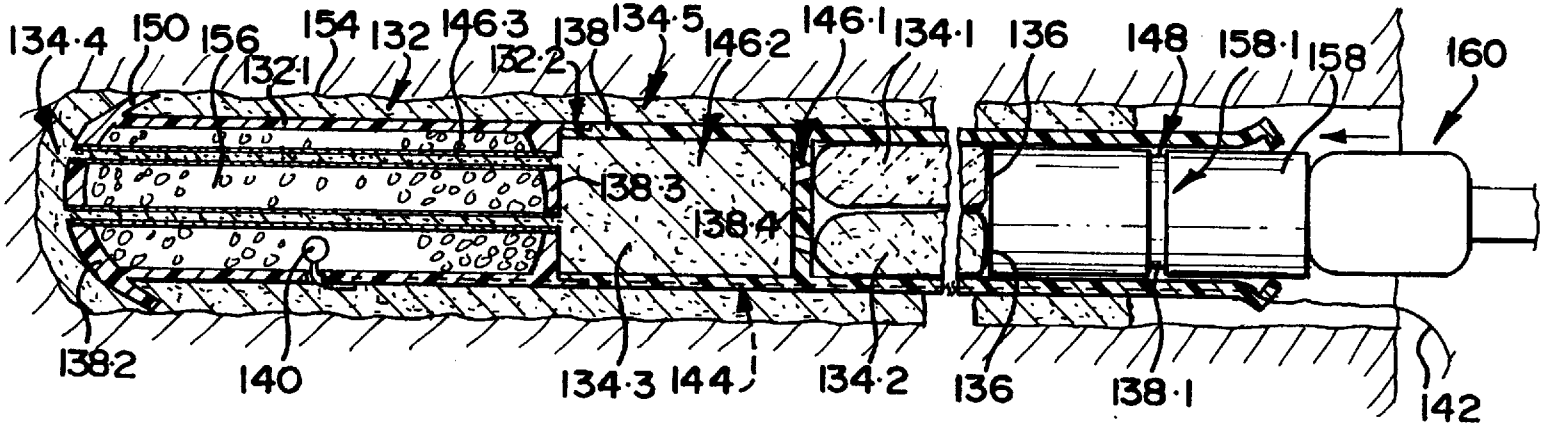
Figure 6:
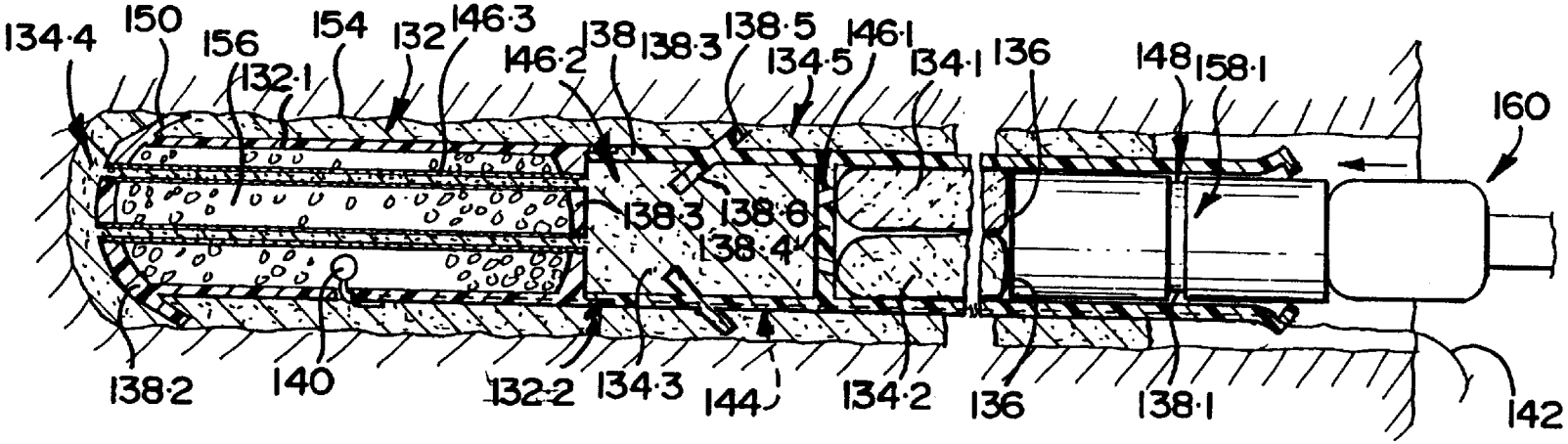
Figure 7:
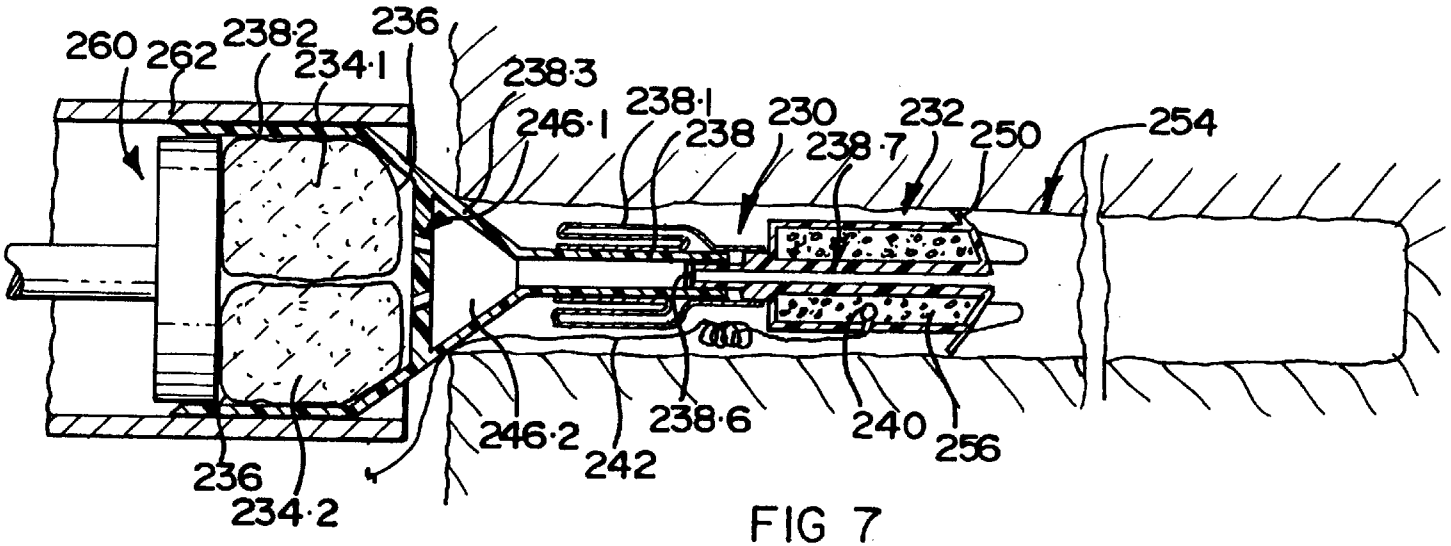
Figure 8:
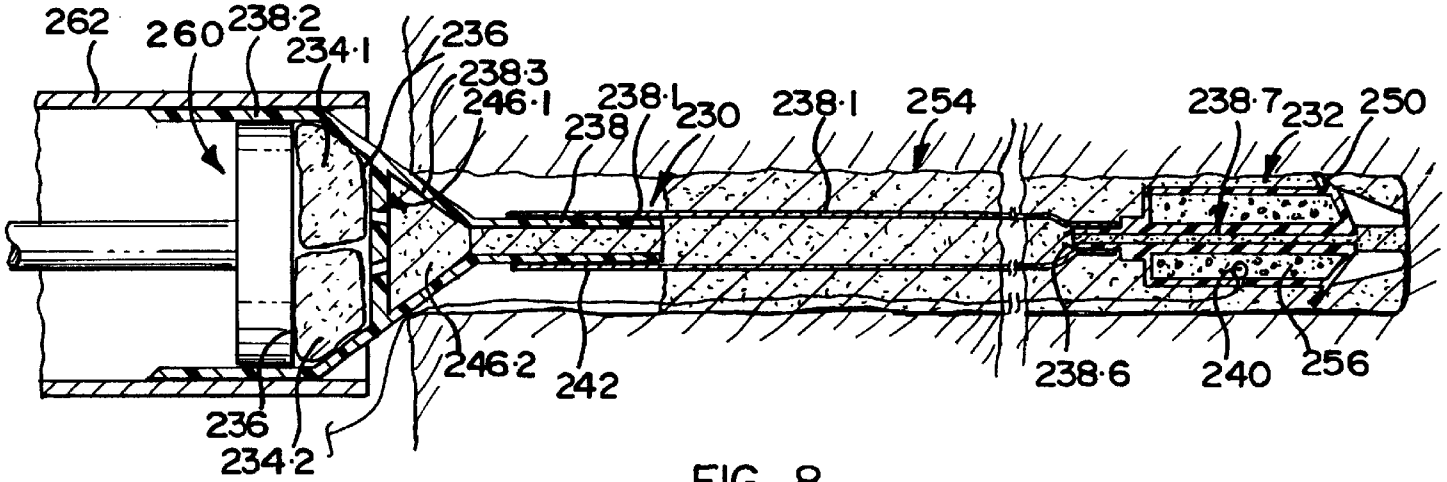
Figure 9:
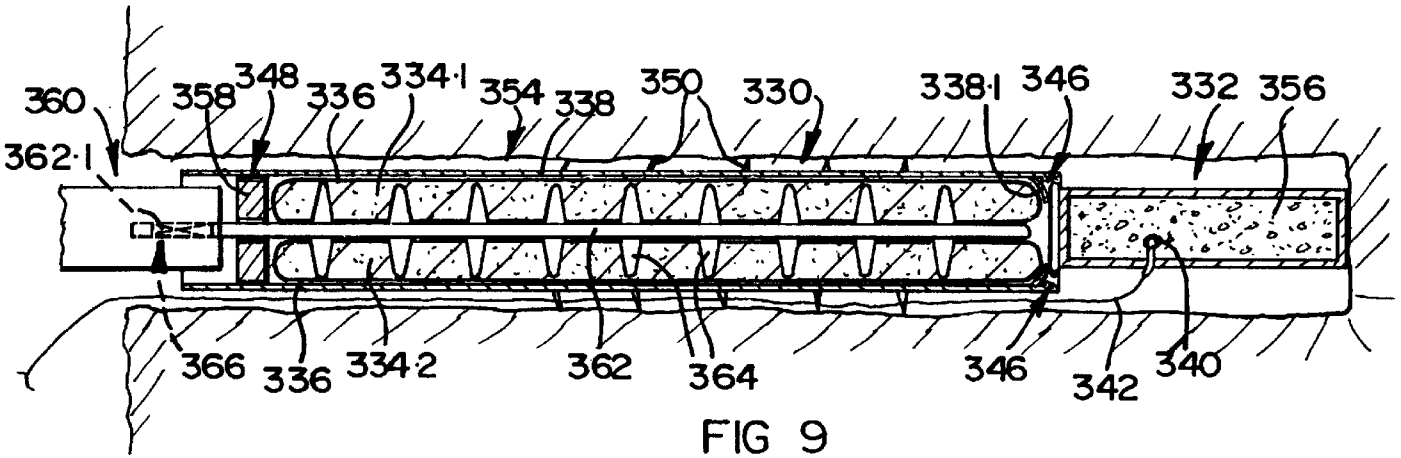
Figure 11:
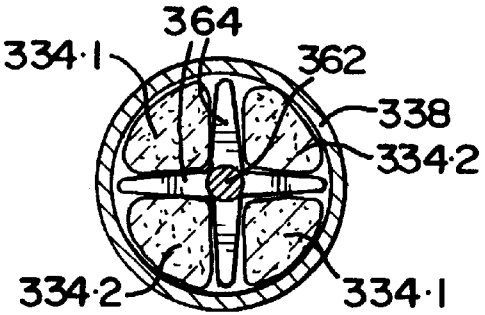
Figure 10:
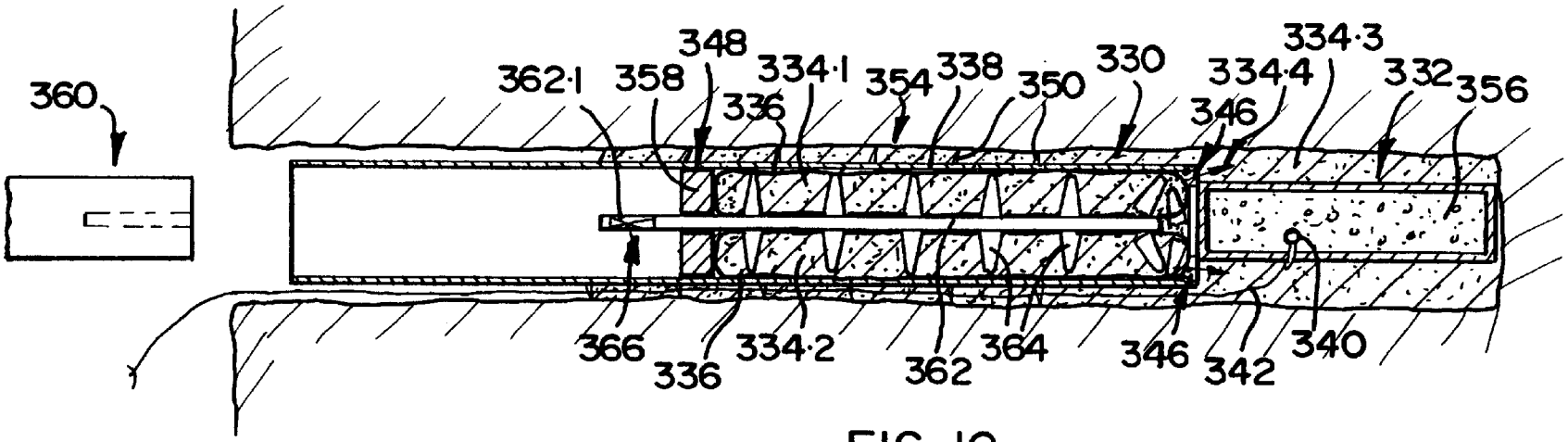

FIG. 6 corresponds to FIG. 5, but shows a developed embodiment;

FIGS. 7 and 8 correspond respectively to FIGS. 4 and 5 but show yet a further embodiment;

FIGS. 9 and 10 correspond respectively to FIGS. 4 and 5 but show yet a further embodiment; and FIG. 11 shows, to a larger scale, a cross-section through the charge of FIG. 9.

Figure 1:
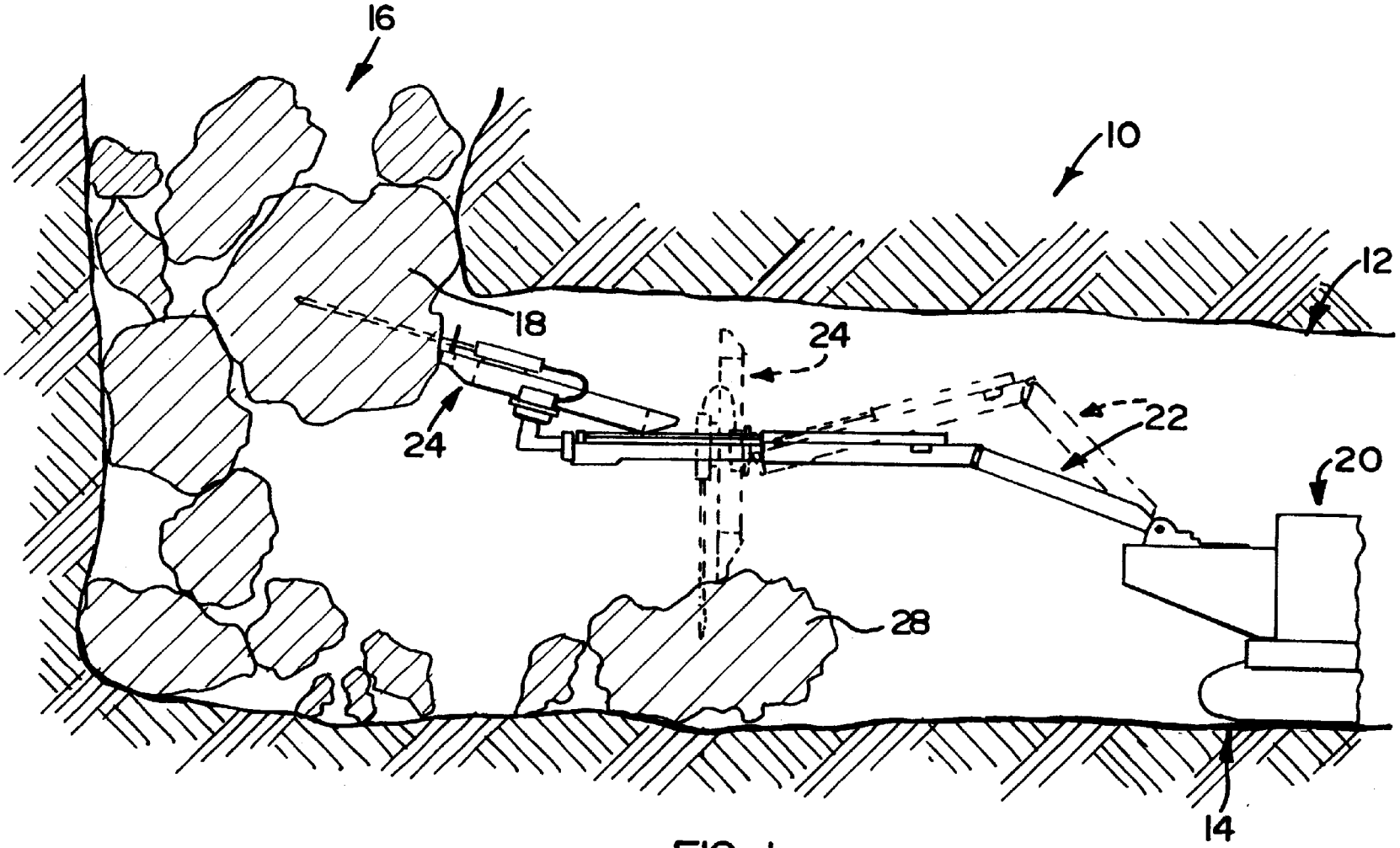
Figure 2:
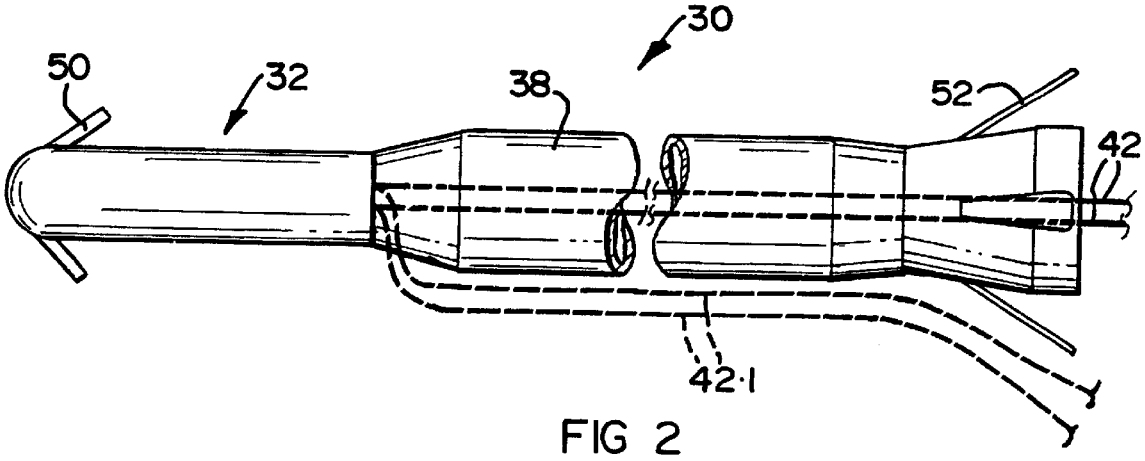
FIG. 2 shows, in side view, a first embodiment of a rock breaking charge in accordance with the invention suitable for use in performing the method of the invention.
Figure 3:
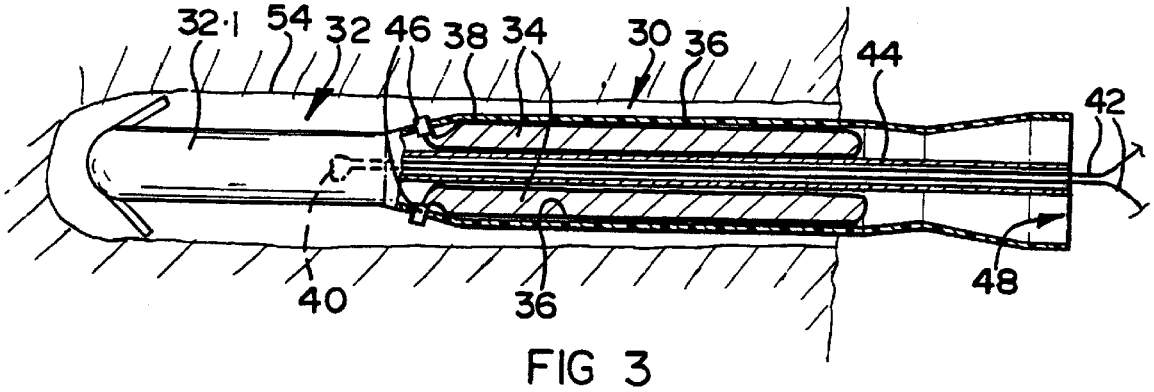
FIG. 3 shows the charge of FIG. 2 in sectional side view.

With reference to FIGS. 1 to 3 of the drawings, an underground mining operation is generally indicated by reference numeral 10. Mining takes place in a mining zone intermediate a hanging wall 12 and a foot wall 14. A throat 16 of a draw point leading into the zone intermediate the hanging wall 12 and the foot wall 14 has been blocked by means of falling rock, including a massive rock 18 stuck within the throat 16. Rock 18 is known in the field of underground mining as a "high overhang" and is regarded as particularly troublesome because of difficulty of access and the extremely dangerous overhead position and precarious condition thereof.

In accordance with the invention, a method is performed by means of a mining machine 20 to break or split the rock 18 to clear the throat 16. The machine 20 has an articulated boom 22 mounting a drilling tool 24 at an end thereof.

By means of the articulated boom 22, the front end of the boom mounting the drilling tool 24 is offered to the rock 18. The drilling tool 24 is brought into operation along an operating axis to drill a hole within the rock 18. By means of indexing means also carried at the end of the articulated boom 22, the drilling tool 24 is withdrawn and charge means is indexed with the hole. A rock breaking charge in accordance with this invention, which is described hereinafter, is charged into the hole and is tamped. The articulated boom 22 including the drilling tool 24, the charging means and the like, is withdrawn from the vicinity of the rock 18. If desired, the machine 20 itself can be withdrawn as well.

With reference more specifically to FIGS. 2 and 3, the charge which is charged into the hole is generally indicated by reference numeral 30. The charge 30 is shown in integrated form. The charge 30 is suitable to be launched from a barrel.

The charge 30 comprises a cartridge 32 at the leading end of the charge 30, followed by a tamping medium 34 contained in flexible containers 36 which in turn are surrounded by and contained in a casing 38. An outer wall 32.1 of the cartridge 32 and the casing 38 effectively form a composite casing.

As can be seen in FIG. 3, the cartridge 32 contains a fuse head 40 which is electrically actuable. Conductors 42 are anchored in the fuse head 40 and extend centrally through a passage 44 provided for that purpose along the charge 30 to and beyond a rear end of the charge 30. In FIG. 2, an alternative embodiment is shown where the conductors, shown in dotted lines at 42.1, extend along a side of the casing 38.

The cartridge 32 is loaded with propellant and the fuse head 40 will be adapted, when electrically actuated, to actuate the propellant in turn.

In the embodiment of FIGS. 2 and 3, within the casing 38, there is provided an annular container 36 of flexible material containing a tamping medium 34 which is in the form of a settable, flowable substance, e.g. grout.

At a longitudinal position immediately behind the cartridge 32, and in peripherally spaced arrangement, there is provided a plurality of passage means in the form of ports 46.

When the charge 30 has been placed at the bottom of the hole 54 in the rock to be broken, an annular ram or plunger complemental to the cross-sectional configuration of respectively the casing 38 and the inner tube 44, is urged from the rear through an annular open end 48 of the charge 30 and into the casing 38 to urge the tamping medium 34 from the annular container 36 via the ports 46 into spaces in the bottom region of the hole 54 surrounding the cartridge 32. The tamping medium 34 may, for example, be in the form of a grout or other suitable settable, flowable substance. When the tamping medium 34 has been urged from the container 36, it is allowed to set. The drilling machine and other equipment, if desired, may be withdrawn from the rock to be broken prior to the fuse head 40 being actuated electrically from a remote position to actuate the propellant to break the rock.

With reference to FIGS. 4 and 5, a further embodiment of a rock breaking charge in accordance with the invention is generally indicated by reference numeral 130. The charge 130 is similar in many respects to the charge 30 of FIG. 3 and like reference numerals refer to like features or components. The similar features or components are not again described in detail and emphasis will be placed on differences between the embodiments.

The charge 30 has an integrated casing 138 in the form of a sleeve of synthetic polymeric material joined spigot-socket fashion as shown at 132.2 to the casing 132.1 of the cartridge 132.

The integrated casing 138 has a rounded front end 138.2 forming a leading end of the charge 130. Rearwardly spaced from the front end 138.2, there is provided an intermediate partition 138.3 defining the rear end of the cartridge 132. The propellant 156 is contained intermediate the front end 138.2 and the intermediate partition 138.3.

Spaced rearwardly from the intermediate partition 138.3, there is provided a rear partition 138.4. A mixing chamber 146.2 is defined intermediate the intermediate partition 138.3 and the rear partition 138.4. Rearwardly of the rear partition 138.4, a trailing portion of the casing 138 is open ended as shown at 148 defined by peripheral, inwardly turned lips 138.1. A plunger 158 is received partially in the rear end of the casing 138. It has, intermediate its leading and trailing ends, a peripheral groove 158.1 within which the lips 138.1 are received to locate it axially in position.

Intermediate the rear partition 138.4 and a leading end of the plunger 158, there is provided a plurality of containers 136 containing respectively the two components of a two component synthetic resin. The components are respectively indicated by reference numerals 134.1 and 134.2. Two containers 136 containing the two components are shown in FIG. 4.

Passage means including ports 146.1 through the rear partition 138.4 communicate the interior of the containers 136 and thus the respective components 134.1 and 134.2 with the mixing chamber 146.2. From the mixing chamber 146.2, through the intermediate partition 138.3, there are provided longitudinal passages in the form of tubes 146.3 extending up to and through the rounded front end 138.2.

A ram 160 is provided for use with the charge 130. The ram 160 has a ram body by means of which the plunger 158 can be urged forward by forcefully pushing out the lips 138 from the groove 158.1 to allow the plunger 158 to compress the containers 136 and to urge the two components 134.1 and 134.2 out of the containers 136, via the ports 146.1 and into the mixing chamber 146.2 where the respective components are exposed to each other and are mixed. The mixture is urged via the tubes 146.3 into the bottom of the hole 154 to displace air from spaces surrounding the cartridge 132 and to surround the cartridge 132 and a portion of the casing 138 as shown respectively at 134.4 and 134.5.

The two component synthetic resin is allowed to set.

The fuse head 140 is served by conductors in the form of a thin cable 142 which is advantageously received in a groove 144 provided for that purpose along the casing 138.

As mentioned before, the fuse head 140 is actuated electrically from a remote position which in turn actuates the propellant 156 to break the rock.

With reference to FIG. 6, the only further feature of the embodiment of FIG. 6, is that peripheral, oblique, external anchor formations 138.5 are provided in peripherally spaced arrangement around the casing 138 and complemental, oblique, internal anchor formations 138.6 are provided in peripherally spaced positions. When the tamping medium has set, the anchor formations prevent the casing 138 which is in the form of a cylindrical synthetic polymeric sleeve, to be released from the hole.

With reference to FIGS. 7 and 8, the cartridge 230 is initially placed in the hole 254 just beyond a mouth thereof. Tamping medium is provided in the form of components 234.1 and 234.2 of a two-component synthetic resin in a reservoir 238.2 which is not inserted into the hole 254. The reservoir 238.2 functionally forms part of the casing 238. Leading the reservoir, there is a part-conical portion 238.3 leading convergingly to the central portion of the casing indicated by reference numeral 238 and which is in the form of a central tube. The cartridge 232 is mounted at the front end of the casing 238 and a central passage 238.7 is provided through the centre of the cartridge 232. A rupture disc 238.6 prevents communication between the casing 238 and the passage 238.7.

Mounting of the cartridge 232 to the front end of the casing 238, is via a flexible sleeve 238.1 which is initially in folded-back configuration.

Also the electrical conductor 242 is coiled up inside the hole 254 such that it can easily be elongated.

The reservoir 238.2 is releasably received within a removable cylinder 262. A ram 260 is offered concentrically with the reservoir 238.2 and the removable cylinder 262 to urge the two components 234.1 and 234.2 out of their containers 236 via ports 246.1 into and through a mixing chamber 246.2, and thence via the casing 238 where it imparts pressure to the rupture disc 238.6. Such pressure pushes the cartridge 232 forward and further into the hole 254, which is allowed by the flexible sleeve 238.1 which unfolds.

When the cartridge 232 has progressed to the bottom of the hole 254, or when it has been extended to its utmost, further pressure ruptures the rupture disc 238.6 as shown in FIG. 8 which causes the mixed synthetic resin to progress via the passage 238.7 through the cartridge 232 to the bottom of the hole where it displaces air from the spaces surrounding the cartridge 232. When the air has been displaced sufficiently, the removable cylinder 262 and ram 260 are removed together with the drilling machine and other equipment. The resin is allowed to set and the propellant 256 is set off from a remote position.

With reference to FIGS. 9 and 10, yet a further embodiment of a rock breaking charge 330 includes a central spindle 362 extending into the casing 338 which is of round cylindrical shape. A plurality of paddles 364 is provided at longitudinally spaced positions and circumferentially arranged on the spindle 362.

As can best be perceived from FIG. 11, four containers 336 are arranged in quadrants formed intermediate wings of the paddles 364 and contain respectively the components 334.1 and 334.2 of the synthetic resin.

A plunger 358 is provided near the trailing end of the spindle 362 and, rearward of the plunger 358, there is provided an a-circular formation, for example flats on the end region of the spindle 362. A ram 360 having a complemental socket 362.1 is received over the a-circular portion of the spindle 362.

When the charge 330 has been placed at the bottom of the hole 354, the ram 360 is engaged with the end of the spindle and is simultaneously rotated and pushed forward. Rotation causes the spindle and thus also the paddles 364 to rotate thus breaking the containers 336 and mixing the components 334.1 and 334.2. Continued pressurizing of the mixed resin forces the mixed resin via rupture discs 338.1 at a fore end of the cylindrical casing 338 to eject via ports 346 provided for that purpose to displace air from spaces around the cartridge 332 and to fill those spaces with resin. Excess resin flows rearwardly externally of the casing 338.

When the resin has set, the propellant 356 is set off from a remote position.

What is claimed is:

1. A rock breaking charge, including:

a casing which is elongate having a leading end and a trailing end, the leading end being of generally round cross-section and suitable for insertion into a hole drilled into a rock;

a cartridge, which includes a pressure generating substance and actuating means for actuating the pressure generating substance, located in the casing toward the leading end;

a tamping medium in flowable form contained in the casing such as to be exposed to pressure applied at the trailing end of the casing in use; and at least one port in the casing arranged in communication with the tamping medium to expel tamping medium from the casing when the tamping medium is pressurized in use.

2. A rock breaking charge as claimed in claim 1 in which the cartridge forms the leading end of the casing, an outer wall of the cartridge forming the leading end of the casing.

3. A rock breaking charge as claimed in claim 2 in which said outer wall of the cartridge is of reduced cross-section or diameter compared to a remainder of the casing, and in which said at least one port is directed to expel tamping medium externally adjacent said outer wall.

4. A rock breaking charge as claimed in claim 1 in which said tamping medium is contained in a flexible container in the casing trailing the cartridge, the flexible container being communicated with said at least one port and being exposed to the trailing end.

5. A rock breaking charge as claimed in claim 1 in which exposure of the tamping medium to the trailing end is via a plunger plungingly provided in the casing at the trailing end and directed at the flexible container containing the tamping medium, and which is plungable into the casing to pressurize the tamping medium.

6. A rock breaking charge as claimed in claim 1 in which the tamping medium is in the form of a single component settable substance.

7. A rock breaking charge as claimed in claim 1 in which the tamping medium is in the form of a two-component substance required to be mixed to induce setting, which rock breaking charge includes a mixing chamber intermediate the tamping medium and said at least one port, and in which communication between said at least one port and the tamping medium is via the mixing chamber.

8. A rock breaking charge as claimed in claim 1 in which the trailing end of the casing is of enlarged cross-section and provides a cylinder to receive a plunger to compress the tamping medium, in which an intermediate portion of the casing intermediate the leading end and the trailing end is extendible, and which rock breaking charge includes a passage extending via said intermediate portion to said at least one port which is situated proximate the cartridge beyond the intermediate portion.

9. A rock breaking charge as claimed in claim 8 in which the passage is closed at a position beyond the intermediate portion toward the leading end by means of a pressure sensitive closure adapted to open at a predetermined pressure.

10. A rock breaking charge as claimed in claim 1 in which the tamping medium is in the form of a two-component substance required to be mixed to induce setting, which rock breaking charge includes an agitator accessible from the trailing end for operation to mix the two-component substance prior to expelling it via said at least one port.

* * * * *